US005815946A

United States Patent [19]

Dean

[11] Patent Number: 5,815,946

[45] Date of Patent: Oct. 6, 1998

[54] METHOD FOR DEHYDRATING WET COAL

[76] Inventor: Miles W. Dean, P.O. Box 201341, Anchorage, Ak. 99520

[21] Appl. No.: 709,252

[22] Filed: Sep. 10, 1996

[51] Int. Cl.[6] ..... F26B 3/00

[52] U.S. Cl. ..... 34/340; 34/329; 34/330; 44/572; 44/574; 44/620

[58] Field of Search ..... 34/338, 340, 348, 34/349, 350, 351, 389, 352, 354, 357, 358; 44/572, 501, 574, 608, 620, 621, 626

[56] References Cited

U.S. PATENT DOCUMENTS

| | | | |
|---|---|---|---|
| 4,176,011 | 11/1979 | Knappstein | 201/40 |
| 4,185,395 | 1/1980 | Nakako et al. | 34/389 |
| 4,403,996 | 9/1983 | Matsuura et al. | 44/1 G |
| 4,508,539 | 4/1985 | Nakai | 44/10 D |
| 4,511,363 | 4/1985 | Nakamura et al. | 44/1 G |
| 4,866,856 | 9/1989 | Feeley | 34/340 |
| 4,904,277 | 2/1990 | Najjar et al. | 44/51 |
| 4,950,307 | 8/1990 | Najjar et al. | 44/51 |
| 5,199,185 | 4/1993 | Davidson | 34/12 |

*Primary Examiner*—Henry A. Bennett
*Assistant Examiner*—Pamela A. Wilson
*Attorney, Agent, or Firm*—John R. Kirk, Jr.; Jenkens & Gilchrist PC

[57] ABSTRACT

A process is described whereby wet coal may be dehydrated and inhibited against rehydration by immersing in a bath of molten paraffin hydrocarbon for a sufficient period of time to evaporate and expel inherent water from the coal. The hydrocarbon then inhibits any rehydration period. It is also an embodiment of this invention to describe a process whereby the water expelled may be recovered for useful purposes.

19 Claims, 1 Drawing Sheet

METHOD FOR DEHYDRATING WET COAL

BACKGROUND

1. Field of the Invention

The present invention relates to a method for improving wet coal by dehydrating it, inhibiting its rehydration and additionally recovering the water as a useful commodity. More particularly, the invention relates to a method for the production of a coal having higher heating value from wet coal, such as brown coal, lignite and other sub-bituminous coals having high moisture content. The present invention involves recovering usable water from such wet coals.

2. Brief Description of the Prior Art

Wet coals, such as the brown coal, lignite and other young sub-bituminous coals, commonly found in the Western United States, have excessive amounts of moisture, defined generally as greater than 14% by weight. Some of this moisture is extremely difficult to remove since it is inherent moisture, that is to say it is "retained" in the molecular structure of the coal. Not only does the high moisture content diminish the heating value (BTU value) of the coal, the cost of transporting water included in the coal is high. Water content of many of the Western United States coals can run easily as high as 33% by weight. Therefore, the economics of shipping certain coals, particularly those found in Alaska and other remote locales makes them non-competitive as an energy source. In certain of the plains areas of the United States, the coal is mined in arid areas where water is a valuable commodity. Thus, a process for dehydrating coal makes it more valuable where the water can also be recovered in useful quantity and quality. The sale of recovered water greatly improves the economics of the coal dehydration.

Various methods have been attempted in order to dehydrate coal, either for subsequent use as a fuel or as a feedstock for another process. For instance, U.S. Pat. No. 4,176,011 describes pre drying coal for coke processes by grinding the coal finely and bringing it into contact with a current of hot inert gas. Of course, the availability of coke oven gases is necessary for the practice of this process and it does not deal with the primary problems connected with low grade, wet coal.

Other prior art teaches the formation of a hot slurry of coal followed by dehydration through indirect heat exchange (U.S. Pat. No. 4,185,395), performing a non-evaporating dehydration treatment (U.S. Pat. No. 4,403,996), crushing and pressing the coal at ambient temperature followed by a heating step (U.S. Pat. No. 4,508,539), dry distillation (U.S. Pat. No. 4,511,363), and using an electrical charge and discharge to remove the water (U.S. Pat. No. 5,199,185).

It is widely known that when the moisture content of a low grade coal is reduced, the dehydrated coal will often absorb moisture from the atmosphere or rainwater, such that the coal will increase in moisture content (U.S. Pat. No. 4,511,363). Various attempts have also been made to prevent the rehydration of the coal after a dehydration process through the use of a rehydration inhibitor, such as, for example, a straight chain hydrocarbon (U.S. Pat. No. 4,950,307) or an alcohol with a surfactant (U.S. Pat. No. 4,904,277) added to the dehydrated coal.

All of the foregoing dehydration or rehydration inhibitor processes suffer from one or more deficiency and none recognize the value of the water recovery. Therefore, it is an object of this invention to provide a method whereby wet coal may be dehydrated to provide a higher heating value while at the same time inhibiting the rehydration of the coal.

It is yet another object of this invention to provide a method for obtaining useful quantities of water from wet coal which may be used for agricultural process coking or even drinking.

It is yet another object of this invention to reduce sulfur and ash content of coal during dehydration of the wet coal.

SUMMARY OF THE INVENTION

The above objects of this invention are accomplished in the following described processes. The low grade wet coal is passed through a bath of molten paraffinic hydrocarbon, normally solid at room temperature, for a period of time such that the water, including inherent water, is removed from the coal. This forms a solid liquid mixture while the water is driven off and expelled into, and through, the molten hydrocarbon bath to collect in space in the bath vessel above the molten hydrocarbon. During the removal of the water from the coal, the molten paraffinic hydrocarbon invades the interstices of the coal and forms a coating on the surfaces and in the pores of the coal, which upon returning to ambient temperatures effectively seals the pores of the coal from significant rehydration. The water expelled is collected as a vapor stream along with volatile hydrocarbons, sulfur and particulates from the closed headspace in the bath vessel. The vapors may be filtered to remove particulates and passed through a heat exchanger where the water is condensed and recovered for further treatment and/or use. To facilitate vapor removal, a suction may be taken on the headspace through use of an excavating blower.

The coated coal is removed from the solids liquids mixture in the bath vessel and while still above the melting point of the paraffinic hydrocarbon, and separated from the molten material. The degree of paraffinic hydrocarbon recovery desired dictates the equipment to be used for the separation. Regardless of the severity of the separation steps, some paraffin remains on the coal and acts to inhibit, if not prevent, rehydration by contract with atmospheric water.

In an especially preferred practice of this invention, the lump coal as mined, would be ground to pass a 100 or 150 mesh screen prior to contacting the molten paraffinic hydrocarbon and, upon separation of the coated coal particles from the molten paraffinic hydrocarbon, would be compressed into briquettes or some other form using suitable available equipment for storage, transportation or sale.

DETAILED DESCRIPTION OF THE INVENTION

Figure 1:
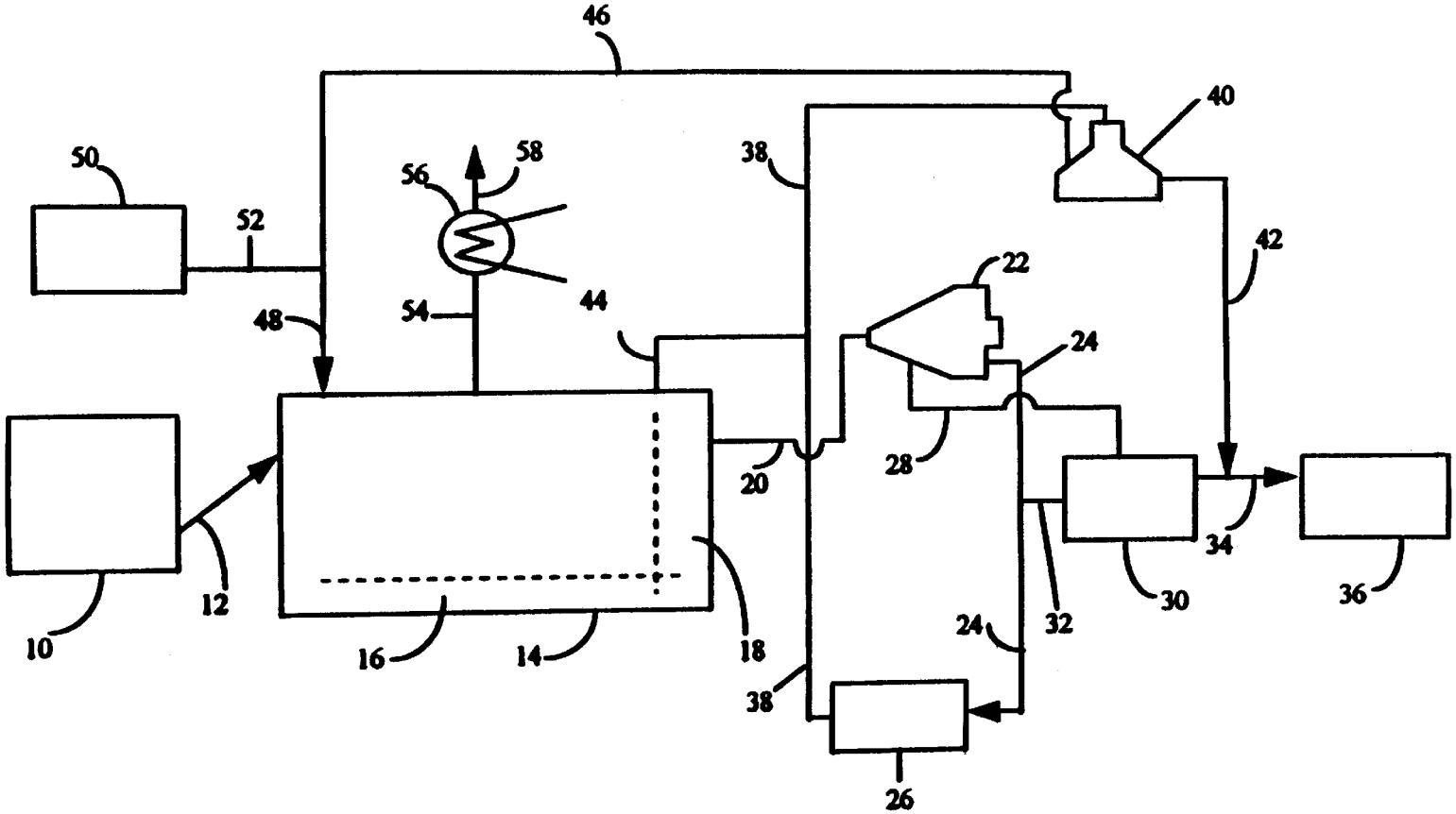
FIG. 1 shows, in schematic form, a general flow diagram for the practice of the coal rehydration process of this invention.

It is preferred that the practice of this invention take place at the location where coal is being prepared for shipment directly from a mine in order to take full advantage of freight savings. Normally, the mined coal is ground into something which approximates 2"×2" mine run lumps. Even these lumps, without further grinding may be treated in the process of this invention for dehydration even though, because of its size would require a longer residence time in the dehydration bath. When use at the water is important at the destination for the coal, the process may be practiced at the coal user's facility, such as a power plant. There is great flexibility in locating and using this invention depending on need.

The coal would be fed continuously through a conveyor, much like a conveyor used to load and unload railcars with coal and fed into the dehydration bath through a liquid trap to a conveyor such as a screw conveyor, preferably a Syntron magnetic pulsating conveyor housed in a sump along the bottom of the vessel, which through its positive action, will move the coal forward into and through a liquid bath where the coal contacts preferably in counter-current flow a bath of molten paraffinic hydrocarbon, normally solid at room temperature, at a temperature above the boiling point of water, and below the boiling point of the paraffinic hydrocarbon. These paraffinic hydrocarbons would normally be a commercial mixture having from about 20 to about 35 carbon atoms, melting at about 120° F. and boiling from about 490° F. to about 540° F. These are normally purchased as mixtures of paraffin waxes recovered from the petroleum refining processes.

The paraffin is charged to the treating bath from a suitable heater which is used to melt the wax and bring the temperature of the paraffin up to the desired bath temperature usually from about 220° F. to about 350° F., preferably from about 310° F. to about 330° F. The heater could be a coal fired steam boiler on the premises which used as-mined coal as a fuel. In order to maintain the bath at sufficiently high operating temperature, it may be necessary to run steam coils or some other appropriate source of energy through the bath vessel so that the temperature of the bath may be maintained at uniformly high temperatures as the coal passes through it and the water is expelled from the interstices of the coal. Preferably, the steam may be generated at a package boiler easily transported to the mine facility and used to melt the wax, bring up the temperature and to maintain the temperature of the dehydrating vessel bath. Further, the steam could be used to trace the path of the coated coal until separated from the paraffin hydrocarbon through the various separation steps in order to maximize the hydrocarbon recovery. The steam tracing can be used to maintain all operating of the process at proper temperatures.

The time of contact between the molten paraffin hydrocarbon and the wet coal will be largely determined by the size of the coal and the temperature of the bath. This residence time may be easily determined by the skilled operating engineer by observing the turbulence of the molten wax. In order to maintain temperature stability it is preferable to have from about 2.5 to about 6 pounds wax per pound coal being treated in the bath. More wax can be used if desired.

On contact with the molten hydrocarbon, the water is evaporated and the coal particles brought to the temperature above the boiling point of water, therefore, vaporizing the inherent water in the interstices of the coal as well as any surface moisture. Simultaneously, with the removal of this water, the coal becomes coated with the hydrocarbon. Even though stringent separation procedures are followed to recover the paraffin, the surface of the coal and the interstices remain coated with the hydrocarbon which effectively prevents rehydration of the coal from occurring, even when the coal is placed in piles and soaked with water. As the coal passes through the molten liquid, a solid/liquid mixture of coal and paraffin is created and at the end of the conveyor, the now dry coal is discharged to fall into a sump in the bath vessel where it is preferably picked up by a vertical conveyor and moved upwardly to outside of the bath vessel to separation means to separate the dry, coated coal from as much of the molten paraffin hydrocarbon as possible to be reclaimed for further use in the bath. This separation means preferably utilizes a commercially available decanter centrifuge (Alfa-Lavale/Sharples, Warminster, Pa. or Houston, Tex.) with the hydrocarbon being returned to the liquid bath. The coated coal itself then would be conveyed preferably to a shaker equipped with a heated screen where additional hydrocarbon may be released from the coal, the coal particles separated and then conveyed to a storage facility. Additionally, another stream of the liquid hydrocarbon from the bath vessel would preferably be transported to a high speed centrifuge to purge suspended solids from the molten hydrocarbon since the presence of coal fines is virtually inevitable in any mined coal.

Turning now to FIG. 1, the wet coal treated in the process of this invention is stored in a hopper 10. The coal may be of any convenient size, as mined it normally is in nominally 2"×2" lumps, but it could conveniently be ground to other common sizes, such as "pea" or "sand" or even to clear various mesh sizes all the way through 100 to about 150 in the case where the coal will be ultimately compressed into briquettes for cooking. The coal moves through a suitable conveyor 12 to the bath 14 containing molten paraffinic hydrocarbon, normally solid at room temperature, usually having from about 20 to about 35 carbon atoms, heated to a temperature greater than the boiling point of water, but less that the boiling point of the paraffin. A temperature that is too high may cause the paraffin to char or break down. The temperature would preferably range from about 220° F. to about 325° F. more preferably from about 250° to about 300° F. Of course, the temperature may be adjusted up or down to improve process ease and convenience and to accommodate different sizes of coal.

The coal enters the bath vessel 14 from conveyor 12 such that it is discharged into the bottom section of the bath below the surface of the paraffin to another conveyor 16, preferably a Syntron steel magnetic pulsing conveyor, located in a longitudinally oriented sump running the length of the bottom of vessel 14 and open to the molten paraffin above. Conveyor 16 moves the wet coal through the molten paraffin at a rate to accomplish a residence time sufficient to evaporate not only surface water, but to expel the inherent water in the interstices of the wet coal. This physical phenomena of extreme agitation of the molten pool has been observed to occur quickly, particularly with finely ground coal sizes. When a mine-run lump coal, about 2"×2", is processed, the time would, of necessity be somewhat longer with the residence time being sufficient for the water removal. The coal moves along conveyor 16 with the molten paraffin in the bath to a vertical conveyor 18, which could be a bucket, belt or screw conveyor which lifts the coal from the solid liquid mixture to exit conduit 20 which moves the coal, now dehydrated and coated with significant quantities of paraffin, to a decanter-centrifuge 22 in which the excess of the liquid phase molten paraffin is removed through line 24 to surge tank 26. The coal exits the decanter centrifuge 22 through conveyor 28, preferably a belt or screw, to a heated screen shaker 30 where additional hydrocarbon is removed and exits the heated screen shaker 30 through line 32 where it joins conduit 24 for conveying the hydrocarbon to surge tank 26. The coal exits the shaker 30 through line 34 and is taken to storage 36 by appropriate conveyors well known for this purpose. The equipment mentioned above is preferably off the shelf items readily available to the industry and the selection of motors, conveyors, pumps, the decanter centrifuge and the heated screen shaker all may be selected by the skilled process design engineer familiar with handling materials like coal. With respect to the decanter centrifuge, the Alfa-Lavale/Sharples' centrifuge is particularly desirable and the capacity of each piece of equipment would be dictated by the output of the mine upon which it is placed or the desired throughput of the process.

The hydrocarbon collected in surge tank 26 is removed, through an appropriate pump (not shown) in line 38 to high speed centrifuge 40. There, any solids or coal fines which remain in the molten hydrocarbon are removed and exit centrifuge 40 through line 42 where the coal joins the coal from the shaker 30 in line 34 and thence to storage 36. The coal in storage is thinly coated with the paraffinic hydrocarbon and virtually impervious to rehydration, even though stored in an open tank or in an outdoor pile, as is common in the storage of coal.

A portion of the molten hydrocarbon is removed from the treating vessel 14 through line 44 and thence to line 38 where it is conveyed to high speed centrifuge 40. From the high speed centrifuge 40 the molten hydrocarbon, still heated, exits through line 46 and is returned to the treating vessel 14 through line 48.

Make up paraffinic hydrocarbon is melted in a heater 50, which can either be direct fired or steam heated. If steam heated, some steam could also be drawn off to feed steam tubes inside of vessel 14 in order to maintain the temperature of the molten paraffinic hydrocarbon at the desired treating temperature. As previously stated, steam tracing may be advantageous throughout the process where the paraffinic hydrocarbon is maintained in the molten state such that the maximum amount may be recovered from the dried coal and returned to vessel 14 for use. The molten hydrocarbon leaves heater 50 through line 52 where it, preferably, joins the recycle stream in line 48. Of course, the make-up feedstream can be fed directly to vessel 14.

The treatment of the wet coal removes water which is expelled through the molten hydrocarbon as a vapor into the headspace of bath vessel 14 where it becomes a vapor stream including not only the water but volatile hydrocarbons from the bath. The vapor stream is collected and removed through line 54 to a condenser 56 (preferably, also an Alfa-Laval equipment) to condense the water vapor in the vapors removed from the vessel 14. Any hydrocarbon or inert gases present would then exit the condenser 56 through line 58 for atmospherically benign collection and/or storage. The line 54 may also include a filter (not shown) prior to the condenser 56 to catch any ash other particulate matter, including possibly particulate sulfur which is removed from the coal being treated. The vapor stream could be pulled from the headspace of the vessel by locating a blower downstream from the condenser to pull a slight vacuum on the vessel 14.

Some modifications of the sequence of the flow sheet shown in FIG. 1 would be made by those skilled in the art in order to take advantage of other permutations and combinations of the process of this invention. For instance, in the event that briquettes are desired, the mined coal would be ground to pass a finer screen, such as a 100 mesh or 150 mesh screen. This crushing would take place in a ball mill or series of ball mills and would probably result in conveyor 12 being changed from a steel chain conveyor, if conveying 2" lumps, to a screw conveyor for conveying smaller size material. Also the treated coal, now coated somewhat, with the paraffinic hydrocarbon to prevent rehydration, be passed would in line 34 to briquetting equipment well known to those skilled in the art, rather than to storage 36. After briquetting occurs, the material is prepared for either sale or storage.

As stated previously, the equipment which makes up the system of apparatus useful in this process may be selected from commonly available, conventional items with the exception possibly of the vessel 14, which preferably would have a sump running the length of it and be baffled at either end such that the coal may be introduced into the vessel beneath the surface of the molten paraffin and be removed from the bottom through the molten paraffin for solids/liquids separation steps. The selection of the conventional equipment would be within the skill of the engineer knowing the throughput volumes for which the plant is designed and the characteristics of the wet coal being treated.

The foregoing description of this invention will be more specifically set forth and illustrated in the following examples which are offered for purposes of illustration only and should not be considered as limiting.

EXAMPLE 1

The procedure employed entailed pulverizing a five gallon bucket full of Healy-Nenana coal (Alaska) in a ball mill; separating the pulverized coal into several particle size classes through sieving; treating some sub-samples of the pulverized coal with commercially available paraffin wax melting at 120° F. and another with wax and a surfactant. One treated sample was pelletized with a hand press. The pulverized coal was sorted by screening with 10, 20 and 40 mesh sieves until about one-half gallon of each size class was available. The wax used was a household, canning grade paraffin wax sold under the trademark "PAROWAX" (Service Assets Corp., Newport Beach, Calif.).

The paraffin wax was heated to a temperature of about 300° F. in an open-top container. The coal samples were placed in the heated wax at a ratio of 1.5 lbs. of coal for 4 lbs. of the molten paraffin wax. The temperature was maintained at about 330° F. for a period of 30 minutes while the coal was being stirred in the hot wax to create a solids/liquids mixture.

The 10 mesh and 20 mesh sub samples were treated with wax only while the 40 mesh sub sample was treated with wax and 2 mm of a surfactant (Amway—wetting agent). It was observed that a vigorous reaction resulted when the wet coal was placed in the molten wax which produced copious quantities of water vapor as steam. Within minutes, the reaction settles down to a rolling boil. Steam production declined rapidly thereafter. After each trail run, the process vessel was decanted by pouring the contents through a sieve. The paraffin was reclaimed and the processed coal was transferred to a brown paper bag and vigorously shaken to remove as much wax as possible. Four such bag absorption steps were used. On completion of all trial runs, one of the treated samples of 10 mesh size coal was pelletized into 1.5 gram spheres.

Samples of untreated and treated coal were analyzed at a commercial laboratory for BTU heating value (ASTM D-2015). The results of that analysis are in Table I below. The presence of the surfactant did not appear to affect the result.

TABLE I

| Coal | BTU/# |
|---|---|
| Untreated | 7,488 |
| 40 Mesh* | 13,069 |
| 20 Mesh | 12,293 |
| 10 Mesh | 12,287 |
| 10 Mesh Pelletized | 12,549 |

*Treated with wax and surfactant

EXAMPLE 2

A coal sample from the Midwestern United States was processed as set forth in Example 1 except that no surfactant was used and analyzed in a commercial laboratory for its heating value in BTUs per pound using ASTM method D-2015. The results of these tests are shown comparing the heating value of an untreated sample on Table II following.

TABLE II

| Coal Sample | BTU lb. |
|---|---|
| As Received | 9,632 |
| 2" × 2.5" lump | 12,778 |
| Pellet - 10 | 13,996 |
| Loose - 10 | 14,239 |
| Pellet - 20 | 14,520 |
| Loose - 20 | 14,156 |
| Pellet - 40 | 15,053 |
| Loose - 40 | 14,947 |
| Pellet - 100 | 15,301 |
| Loose - 100 | 14,921 |

Note that even the heating value of the 2"×2.5" lump pellets was dramatically increased. Thus, indicating that the grinding step could be eliminated and, therefore, the lump coal could be shipped without additional sizing.

EXAMPLE 3

Following the procedure of Example 1 a Montana coal was treated at 320° F. to 330° F. for 7 minutes. These were samples of mixed sizes, including lump through fines. Four applications in paper bags were performed to remove hydrocarbon. The results were obtained from a commercial laboratory using recognized procedures for testing and analyzing coal.

TABLE III

| | | Treated | | |
|---|---|---|---|---|
| | Untreated | Sample 2 | Sample 3 | Sample 4 |
| Moisture, % | 21.59 | 3.73 | 3.23 | 3.19 |
| Ash, % | 8.88 | 2.27 | 4.35 | 2.98 |
| Heating Value, BTU/# | 9164 | 13,223 | 13,441 | 13,331 |
| Sulfur, % | 0.35 | 0.22 | 0.38 | 0.21 |
| $SO_2$, #/MBTU | 0.76 | 0.33 | 0.57 | 0.32 |

From the above description of the process of this invention, those of ordinary skill in the art may make many modifications and adjustments to meet the situation with which they are faced without departing from the scope of the invention described as claimed hereafter.

I claim:

1. A process for dehydrating wet coal which comprises the steps of passing the wet coal through a bath of molten paraffinic hydrocarbon, normally solid at room temperature, with sufficient residence time to evaporate water from the coal and to form a coating on the surfaces and in the pores of the coal with the paraffin in the bath;

separating the coated coal from the bath; and recovering the excess coating from the coal.

2. The process of claim 1, wherein said paraffin is an aliphatic hydrocarbon having from about 20 to about 35 carbon atoms or mixtures thereof.

3. The process of claim 1, wherein the water removed from the coal is recovered.

4. The process of claim 1, wherein the wet coal is passed in countercurrent contact with the molten paraffin.

5. The process of claim 1, wherein the separating of the coated coal is by decanting, centrifuging, shaker screening or a combination thereof.

6. A process for dehydrating wet coal comprising the steps of:

(i) contacting the wet coal in a bath of molten paraffinic hydrocarbon, normally solid at room temperature, for a time sufficient to evaporate water and coat the surfaces and pores of such coal with paraffin to produce a solids/liquids mixture comprising a liquids phase of molten paraffin and a coated coal solids phase, whereby a significant portion of the water in said solids/liquids mixture is evaporated from the coal into the liquids phase of said solids/liquids mixture;

(ii) separating the liquids phase from the solids phase of said solids/liquids mixture;

(iii) recovering the separated solids phase to produce a dehydrated coal inhibited against rehydration with an enhanced heating value; and (iv) recycling the liquids phase obtained to said contacting step (i) as at last part of said molten paraffin bath of said contacting step (i).

7. The process of claim 6 wherein said molten paraffin bath comprises a mixture of aliphatic hydrocarbons having from about 20 to 35 carbon atoms having a boiling point of from about 490° F. to about 540° F.

8. The process of claim 6, wherein said bath is maintained at a temperature between the boiling point of water and the boiling point of the paraffin mixture.

9. The process of claim 8 wherein the temperature of the molten paraffin is from about 220° F. to about 325° F.

10. The process of claim 6, wherein the wet coal is passed through the bath in countercurrent contact with said molten paraffin.

11. The process of claim 6, wherein the coated coal is separated by decanting the liquids phase from said solids phase and centrifuging the mixture.

12. The process of claim 11, wherein the centrifuging separating of said liquid phase from solids phase is followed by screening on a heated shaker screen.

13. A process for recovering useful water by the dehydration of wet coal comprising the steps of:

(i) contacting said wet coal in a bath of molten paraffinic hydrocarbons, normally solid at room temperature, for a time sufficient to expel the water from the coal into the molten paraffin to produce a solids/liquids mixture comprising a liquids phase of molten paraffin, a solids phase of coal and a vapor phase including the water is expelled from the solids/liquids mixture;

(ii) recovering the vapors from the solids/liquids mixture as a vapor stream;

(iii) removing entrained solids from the vapor stream; and (iv) recovering the water from the solids/liquids mixture.

14. The process of claim 13, wherein said molten paraffin bath comprises a mixture of aliphatic hydrocarbons having from about 20 to about 35 carbon atoms having a boiling point of from about 490° F. to about 540° F.

15. The process of claim 13, wherein the water is condensed from the vapor stream.

16. The process of claim 13, which includes the steps of (i) subjecting the separated coated dehydrated coal to solid/liquid separation to maximize removal of liquids phase:

(ii) recycling said liquids phase to said contacting step (i) as at least part of said molten paraffin bath of said contact step; (i); and wherein said recycling of said liquids phase is with the addition of additional molten paraffin to replace that depleted.

17. A method for recovering water from wet coal which comprises the steps of:

contacting wet coal in a bath of a molten paraffinic hydrocarbon, normally solid at room temperature, with sufficient residence time to expel water from the coal to produce a vapor stream comprising steam and volatile hydrocarbon;

removing the vapor stream from the bath; and condensing the water from the vapor stream.

18. A method for preparing coal briquettes from wet coal comprising the steps of:

sizing coal to pass a 100 mesh screen;

passing the sized coal through a bath of molten paraffinic hydrocarbon, normally solid at room temperature, for a time sufficient to evaporate water from the coal and coat the surface and pores of the coal;

removing the coal from the bath;

recovering molten hydrocarbon from the coal leaving a film of hydrocarbon on the coal to inhibit rehydration of the coal; and forming briquettes from the dehydrated coal.

19. The method for recovering water from wet coal of claim 17 which also comprises the step of filtering the vapor stream to remove particulates.

* * * * *